US005629762A

United States Patent [19]

Mahoney et al.

[11] Patent Number: 5,629,762

[45] Date of Patent: May 13, 1997

[54] IMAGE FORMING APPARATUS HAVING A DUPLEX PATH AND/OR AN INVERTER

[75] Inventors: Gregory P. Mahoney, Fairport; Steven M. Russel, Pittsford; Robert M. Peffer, Penfield; Charles D. Odum, Rochester, all of N.Y.

[73] Assignee: Eastman Kodak Company, Rochester, N.Y.

[21] Appl. No.: 474,348

[22] Filed: Jun. 7, 1995

[51] Int. Cl.[6] ..... G03G 15/23

[52] U.S. Cl. ..... 399/364; 271/186; 355/24; 399/396

[58] Field of Search ..... 355/318, 319, 355/320, 309, 208, 24, 311, 212; 271/184–186

[56] References Cited

U.S. PATENT DOCUMENTS

| | | | |
|---|---|---|---|
| 4,487,506 | 12/1984 | Repp et al. | 355/319 X |
| 4,568,169 | 2/1986 | Wada et al. | 355/319 |
| 4,780,745 | 10/1988 | Kodama | 355/319 |
| 5,006,900 | 4/1991 | Baughman et al. | 355/271 |
| 5,159,395 | 10/1992 | Farrell et al. | 355/319 |
| 5,337,135 | 8/1994 | Malachowski et al. | 355/319 |
| 5,473,419 | 12/1995 | Russel et al. | 355/319 |
| 5,493,378 | 2/1996 | Jamzadeh et al. | 355/208 X |

FOREIGN PATENT DOCUMENTS 6-211406 8/1994 Japan .

*Primary Examiner*—Shuk Yin Lee

*Attorney, Agent, or Firm*—Lawrence P. Kessler

[57] ABSTRACT

Image-forming apparatus includes a finite length image member such as a seamed photoconductive loop. Images are formed on the image member in one of three different sized image frames, the first image frame being ½ the in-track length of the third image frame and the second image frame having an intermediate length. Relatively small size images, for example letter size images are formed in the first size frames while relatively large sized images, for example, ledger sized images are formed in the third size frames. Intermediate sized images, for example images for B-4 receiving sheets are formed in the second or intermediate size image frames. Receiving sheets in duplex are passed through a finite length duplex path which has a speed profile which is substantially the same for receiving sheets bearing images formed in the first and third frame lengths but is different, for example faster, for images formed in the second size image frame while use of the same duplex path for the three frame sizes. Sheets are fed into an inverter in the duplex path at a faster speed than is used for most of the rest of the duplex path. After a delay in the inverter, sheets are fed out of the inverter at a substantially reduced speed more easily handled by the downstream portion of the duplex path.

19 Claims, 2 Drawing Sheets

LOGIC & CONTROL
50
LOGIC & CONTROL
50
13
15
20
11
18
3
5
100
22
9
24
19
1
7
17
26
42
44
27
25
33
28
29
31
30
32
34
38

IMAGE FORMING APPARATUS HAVING A DUPLEX PATH AND/OR AN INVERTER

BACKGROUND OF THE INVENTION

This invention relates to image-forming apparatus of the type having a substantially finite length duplex path. It also relates to an inverter usable in such a duplex path and in other applications.

U.S. Pat. No. 5,006,900 to Baughman et al, granted Apr. 9, 1991 shows a typical electrophotographic copier/printer in which toner images are formed on a seamed belt image member and transferred to a receiver sheet at a transfer station. To make duplex copies, the receiving sheet is fed through a finite length path in the form of a loop back to the transfer station. In the course of passing through this duplex path, the receiving sheet is turned over at an inverter so that the opposite side of the sheet is presented to a toner image when it returns to the transfer station. The inverter includes a pair of reversing nip rollers which drive the receiving sheet into an inverter guide until they are clear of the entrance of the inverter. The reversing nip rollers are then driven in the opposite direction to drive the edge of the sheet that had been the trailing edge into a pair of exit rollers and on through the duplex path.

The particular apparatus in the Baughman et al patent was designed to work with an image member that had dedicated image frames. Large size sheets took up double-frames on the image member and small size sheets took up one frame with other variations in sheet or image size being absorbed by a variable interframe. Thus, the duplex path length could readily be an integer multiple of the double-frame in-track length to bring the sheet back to the transfer station in good timing with the next image.

U.S. Pat. No. 5,473,419, filed Nov. 8, 1993 to Russel et al and entitled "Image Forming Apparatus having a Duplex Path With an Inverter" points out that having dedicated frames inefficiently uses the image member except for receiving sheets having an in-track length close to the small or large (double) frame in-track distances. Like the Baughman et al patent, this structure utilizes an image member which is a photoconductive belt having a seam. The seam cannot be imaged upon and therefore makes the image member a finite length for spacing images. The Russel et al application suggests that the images be positioned on the belt to provide the most images of a given length between appearances of the seam. Thus, the image member would be utilized most efficiently for its length for every size image being reproduced. No dedicated frames are involved. This creates difficulties in managing the length of the duplex path which for space reasons is preferably as short as possible. The Russel et al application suggests that the effective length of the return path can be varied by adjusting the speed of movement of the receiving sheet in the path, by varying the path itself by moving guides or, preferably, by varying the length of time the receiving sheet is held in the inverter.

U.S. Pat. No. 5,159,395 to Farrell et al, issued Oct. 27, 1992, is one of a large number of references which disclose various duplex scheduling processes. This reference discloses a very commonly used "interleaf mode" in which images for a particular side (back or front) are made until the duplex loop is filled with one skipped cycle or pitch between each print. Once the receiving sheets approach the transfer station from the duplex path, images are alternated between back and front until the end of the mn when some skipped frames are necessary to finish the last set of receiving sheets in the duplex path. This approach has many advantages including feeding the completed sheets evenly to a finisher or output tray. It also provides a skipped frame in the duplex path between images at all times.

U.S. Pat. No. 5,337,135, granted to Malachowski et al on Aug. 9, 1994, uses a variable speed drive to provide spaces between sheets in a duplex path without skipping frames at the transfer and exposure stations.

U.S. Pat. No. 4,568,169, granted to Wada et al, shows an image-forming apparatus having an infinite image member; i.e., a seamless drum, in which a duplex path transport speed is varied according to the size of the sheet to improve efficiency.

U.S. Pat. No. 4,780,745 to Kodama, granted Oct. 25, 1988, suggests that an inverter in a duplex path can receive a slow-moving sheet and substantially speed it up to ultimately shorten the duplex loop.

In moving paper or other receiving sheets through any paper path at relatively high speeds, it is desirable for costs reasons to have as few sets of rollers or other transport devices operating at varying speeds as possible. Further, reliability problems are more likely to occur when a sheet is being slowed down than when it is being speeded up since the slowing down action tends to create a buckle in the sheet.

SUMMARY OF THE INVENTION

It is an object of the invention to provide an image-forming apparatus having a duplex loop with an inverter in which the tradeoff between reliability and efficiency is improved with respect to the prior art.

According to a first aspect of the invention, an image forming apparatus includes a finite length image member such as a seamed loop photoconductor and means for forming a series of images on the image member. (The "frame length" of each image of a series of images is defined as the intrack distance between a point in an image and a comparable point in the next image, i.e., the "pitch" of the images.) The image-forming apparatus also includes means for holding a supply of receiving sheets, each sheet having first and second sides, a transfer station including means for transferring an image from the image member to a first side of a receiving sheet, and means for feeding receiving sheets from the means for holding to the transfer station with the first side of the receiving sheet oriented to receive a toner image. Means are provided for feeding one or more receiving sheets through a finite length duplex path back to the transfer station to receive another toner image which duplex path includes means for inverting a sheet to change the side of the sheet being presented to a toner image at the transfer station. A logic and control controls the formation of toner images on the image member and the movement of the receiving sheets. It includes means for controlling image formation to form images of different in-track lengths with at least first, second and third different frame lengths wherein the first ("small") frame length is approximately one-half of the third ("large") frame length and the second ("intermediate") frame length is more than the first frame length but less than the third frame length, and means for controlling movement of the sheets through the duplex path at a predetermined speed profile which is substantially the same for sheets bearing images formed in the first and third frame lengths but is different for receiving sheets bearing images formed in the second frame lengths.

According to a preferred embodiment of this first aspect of the invention, the duplex path includes a portion having a variable speed which speed may be higher than the process speed for first, second and third frame lengths but is substantially faster for the second frame length than it is for the first and third frame length. This preferred embodiment allows high productivity for an intermediate size sheet between ledger size and letter size that is common in some portions of the world. At the same time for all other applications of the apparatus, a single speed profile is used.

According to a second aspect of the invention, an image-forming apparatus includes means for forming images on receiving sheets having first and second sides, means for feeding one or more receiving sheets through a finite length duplex path back to the means for forming images to receive another image on the second side of the receiving sheet, and means for inverting a sheet in the duplex path to change the side of the sheet being presented to the means for forming images. The inverting means includes roller means defining an entrance nip to the inverter and roller means defining an exit nip from the inverter and means for driving the rollers defining the entrance nip at a speed to move a receiving sheet at a first speed and means for driving the rollers defining the exit nip at a speed to drive the sheet at a second speed, which second speed is substantially less than the first speed.

According to a preferred embodiment of this second aspect of the invention, the receiving sheet can be substantially sped up during its movement through the duplex path but is slowed down in the inverting means on its way back to the image-forming means. We have found that slowing the sheet down in the inverter is a far more robust way of slowing a sheet down than to try to slow the sheet with ordinary drive rollers. Further, we've also found that driving the sheet into the inverter at a greatly increased speed compared to the process speed permits us to incorporate a delay of the receiving sheet in the inverting means, which in turn provides robustness to the timing of the apparatus. Although this aspect of the invention is particularly usable in a duplex path of an electrophotographic apparatus, it can be used in other applications. It is, thus, an object of the invention to provide an inverter which provides robustness to the timing of any sheet moving application and does not interfere with sheet flow in the downstream portion of the path.

DETAILED DESCRIPTION OF THE INVENTION

Figure 1:
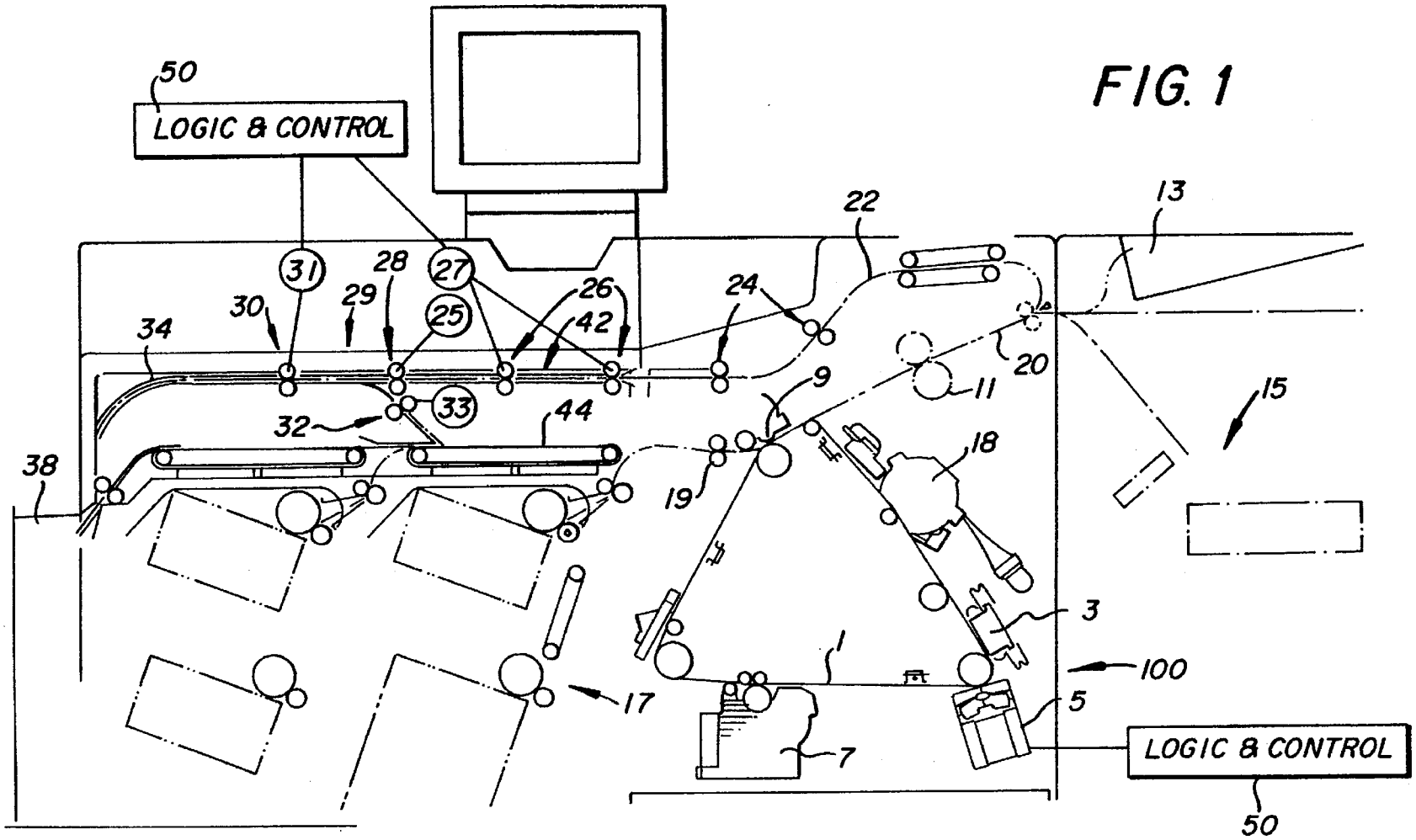
FIG. 1 is side schematic of an image-forming apparatus.

Referring to FIG. 1, an image-forming apparatus 100 is an electrophotographic copier or printer. The invention will be described as applied to this apparatus, for which it is particularly usable. However, many aspects of the invention can be used in other printing, copying or duplicating apparatus dependent on other technologies, for example, ink jet or offset duplication.

According to FIG. 1, an image member 1, for example, an endless photoconductive belt is trained about a series of rollers for movement through a series of stations to create toner images. At the present state of the technology, such belts are generally seamed utilizing a seam which cannot be used for imaging. Thus, although the belt is continually usable as it moves around its path, it has a finite length as seen by a station, which length is equal to the distance between the end of the seam and the beginning of the seam.

Images are formed conventionally. More specifically, a charger 3 applies a uniform charge to the surface of image member 1. The image member is imagewise exposed at an exposure station, for example, an LED printhead 5, to create an electrostatic image on the image member. The electrostatic image is toned at a toning station 7 to produce a toner image on the image member. The toner image is transferred at a transfer station 9 to a receiving sheet fed from a receiving sheet supply 17. The receiving sheet is separated from the image member and fed through a fuser 11 where the image is fixed to the receiving sheet and conveyed from there to any of several destinations, including an output tray 13, a finisher 15 or into a duplex path 22. The image member 1 is cleaned at a cleaning station 18 for continuous reuse.

A "simplex" paper path 20 of image-forming apparatus 100 extends from paper supply 17 to either output hopper 13 or finisher 15. Paper supply 17 can include many individual supplies of the same or different size sheets as shown on the drawing, in fact the paper path can be extended back to an auxiliary paper supply 38 which can be positioned next to the main portion of image forming apparatus 100.

A duplex path 22 includes a large portion of the simplex path 20 and is, for the most part, a typical finite length duplex path. That is, a path without a buffer such as a duplex or intermediate tray. It extends through duplex path feed rollers 24, variable speed rollers 26, an inverter 29 and back to a return portion 44 of the simplex path 20 which carries the sheet back to the transfer station 9. A registration device 19 eliminates cross-track, in-track and skew misregistration from the sheet before it is fed to transfer station 9.

A logic and control 50 controls the formation of the images and the movement of the receiving sheets. It controls the placement of images on the image member 1 by controlling the printhead 5.

Modem high volume copiers and printers are equipped to handle a large variety of paper sizes, often extending from an in-track length of 7 or less inches to 17 or more inches and including 15 or so different in-track lengths. The most common letter sizes in the United States and Europe, when positioned in a portrait orientation are 8½ inches and 210 millimeters in in-track length, respectively, with their ledger size (in landscape orientation) approximately twice that. Thus, in both the United States and Europe the most common sizes could be handled productively with a single or small in-track frame length of about 9 inches and a double or large in-track frame length of about 18 inches. With such an arrangement, all images equal to or less than the size of the single frame length would be produced at twice the productivity of those greater than that single frame size.

Although this is reasonably efficient for these common American and European sizes, the Japanese B-4 size has an in-track length of 256 mm (10.1 inches) and would be forced to go at the slower productivity. On the other hand, to increase the frame size enough to accommodate B-4 on the small frames would reduce the productivity of American and European letter and ledger size sheets noticeably, which sizes are the bread and butter of high volume copying.

Applicants have solved this problem by creating an intermediate frame size between the small and large frame sizes and by providing a variable speed drive in the duplex path which drives intermediate size sheets through a portion of the duplex path at a faster rate to maintain their appropriate timing.

For example, utilizing an image member having a length of 57.22 inches which runs at a process speed of 17.48 inches per second six small frames having an in-track frame length of 9.54 inches provides 110 letter sized images per minute in portrait orientation. This small frame size is used for all receiving sheets nine inches in in-track length or less. Similarly, sheets having in-track length from 11 through 18 inches are fit into large size frames having an in-track frame length of 19.08 inches, twice that of the small frames. Since three of these frames are fit on the image member length, the image-forming apparatus produces 55 large images per minute at the full process speed.

For B-4 receiving sheets, the image member is split into five frames having an in-track length of 11.44 inches and providing a productivity of 92 images per minute. This illustrates the advantage of the third frame size. With only two frame sizes, either the B-4 receiving sheet must be operated at 55 images per minute (instead of 92 images per minute) or the letter size receiving sheet must be operated at 92 images per minute (instead of 110 images per minute). In either case, the reduction in productivity is an unacceptable compromise in many environments.

Preferably, duplex image scheduling is by interleaf mode, described above. In interleaf mode, the duplex path time is preferably an odd integer multiple of the frame time.

Duplex path time or "loop time" is the time for a leading edge of a sheet to travel from any one station (for example, registration station 19) through the duplex path and back to that station. As will be explained in more detail, the duplex path times vary for the three frame lengths.

The "frame time" is the time for one frame length or pitch of the image member to pass a point on its path. In the above example, the image member takes 3.273 seconds per cycle. Thus, the frame time for letter, ledger or B-4 frame lengths is thus 0.545, 1.09 and 0.655 seconds, respectively. Although this duplex path length itself is commonly referred to as having a finite length since it has no duplex tray or other similar buffer, it, in fact, is a path that varies slightly because the different length sheets extend different distances into inverter 29.

For letter size or small size sheets using the small frames of image member 1, the duplex path is long enough to accommodate nine frames and the sheets are fed at a speed or velocity profile to return them to the registration rollers 19 and then the transfer station 9 in proper timing for receiving the image on the reverse side. Since, for interleaf mode an odd number of frames must fit in the duplex path, the same path accommodates five large size frames and seven intermediate size frames. However, nine small frames do not equal five large frames since the large frames are exactly twice the length of the small frames on image member 1. This difference is accommodated in part by varying the time the sheets dwell in the inverter according to their size. However, seven intermediate size frames will not reach back to the transfer station in time for its next image even with zero dwell time in the inverter 29. Thus, for sheets fitting intermediate frame sizes the transport speed for a portion of the duplex path is substantially increased thus providing a different velocity profile for intermediate size sheets in the duplex path.

For example, image forming apparatus 100 uses a process speed at position 40 where the sheet is in contact with image member 1 of 17.48 inches per second. This process speed is maintained until the largest sheet is through fuser 11. Thus, although speeds may vary slightly, the process speed is substantially maintained through duplex path feed rollers 24. Variable speed rollers 26 are driven by a variable speed drive 27 which is controlled by logic and control 50 to drive sheets originally imaged in either small or large frame sizes at an increased speed of approximately 26 inches per second. For B-4 size (intermediate size) receiving sheets, variable speed drive 27 drives rollers 26 to feed the sheets at approximately 55 inches per second into inverter 29. This difference in speed for this length provides the necessary effective shortening of the path to both allow the intermediate size sheets to arrive back at transfer station 9 at the correct time and also provides some dwell time in inverter 29 to remove timing criticality from the system.

Inverter 29 is fairly conventional except for the speeds at which the rollers defining it are driven. It includes a pair of entrance nip rollers 28 driven by an entrance nip roller drive 25, a pair of reversing nip rollers 30 driven by a reversible drive 31, a pair of exit nip rollers 32 driven by an exit nip roller drive 33 and an inverter guide 34, all as shown in FIG. 1. More details of inverter 29 are shown with respect to FIGS. 2–4. However, its function in the FIG. 1 apparatus is best described with respect to FIG. 1.

Utilizing the size and speed examples cited above, small and large size receiving sheets driven by variable speed rollers 26 at 26 inches per second are fed into entrance nip rollers 28. Intermediate size receiving sheets are fed by variable speed rollers 26 at 55 inches per second into entrance nip rollers 28. Entrance nip rollers 28 are driven at 55 inches per second at all times. This doubles the speed of the small and large sheets, overdriving rollers 26 if the sheet extends back through them. Reversing rollers 30 continue to drive the sheet at 55 inches per second into guide 34 until the trailing edge of the sheet clears the entrance nip defined by rollers 28. Reversing nip rollers 30 are then stopped for a desired dwell time. In response to an appropriate signal, described below, reversing nip rollers 30 are reversed and drive the sheet, accelerating toward 26 inches per second, original trailing edge first into the exit nip defined by exit nip rollers 32 which are driven at a constant speed of about 26 inches per second. The exit nip rollers 32 drive the sheet down into the return (and paper supply) portion 44 of the simplex path which also moves the receiving sheet at a speed of about 26 inches per second. Registration device 19 further slows the sheet to the process speed of 17.48 inches per second.

The apparatus shown in FIG. 1 is operated with three distinct frame lengths on a seamed image member 1. It provides remarkable productivity not only for letter and ledger-sized sheets but also for the intermediate size B-4 sheets with an extremely robust design.

Figure 2:
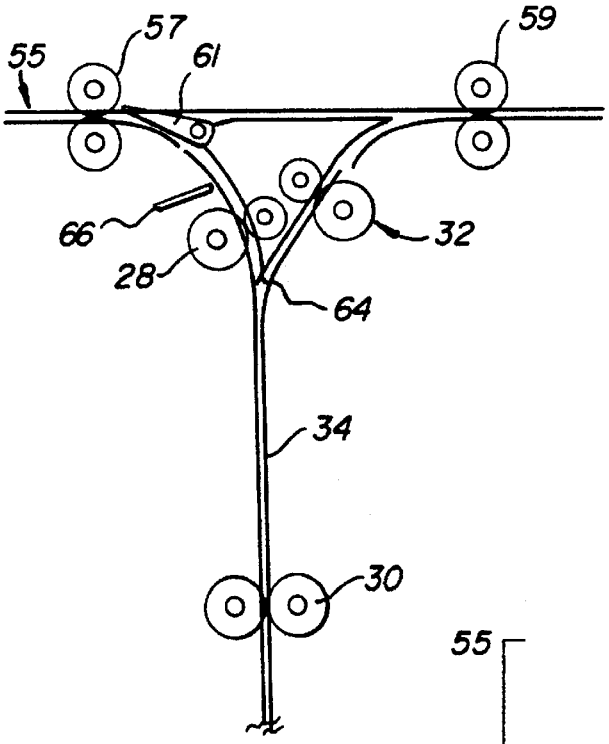
FIGS. 2 and 4 are side and top schematics of portions of an inverter.
Figure 3:
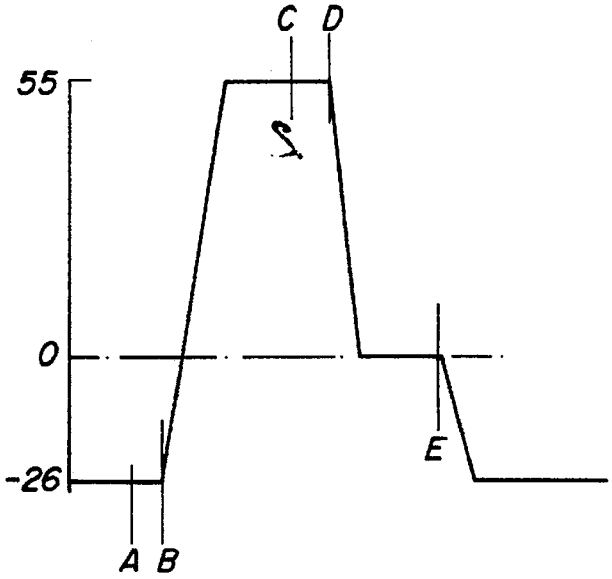
FIG. 3 is a timing diagram of the velocity control of a reversing nip in an inverter.
Figure 4:
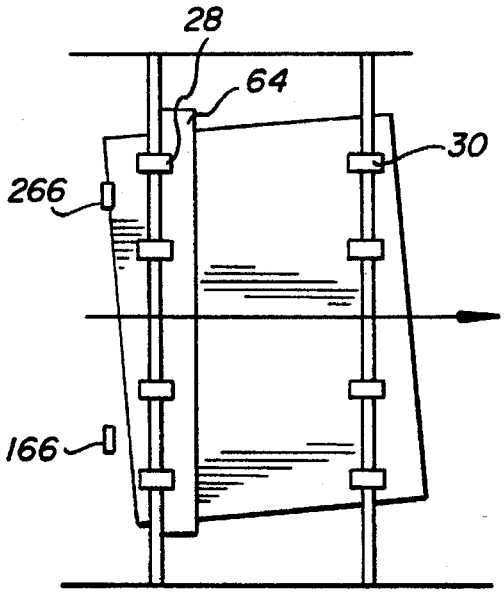

FIGS. 2–4 help describe the structure and operation of inverter 29 in more detail. Although the inverter 29 shown in FIG. 1 is used in a particularly advantageous environment of the FIG. 1 apparatus, it can be used in other apparatus as well. Conventional inverters of the tri-roller type necessarily have identical speeds in both their entrance and exit nips. This has also been the case with many four (4) roller designs. The inverter is shown in FIG. 2 as a deviation from a relatively straight paper path 55 which includes upstream rollers 57 and downstream rollers 59. Sheets not to be inverted can pass directly from rollers 57 to rollers 59. A diverter 61 intercepts a sheet to be inverted moving along path 55 after it passes through upstream rollers 57. The sheet is diverted into an entrance nip defined by entrance nip rollers 28. Entrance nip rollers 28 accelerate the sheet to two or more times as fast as it was moving in straight paper path 55. A plastic gate 64 urges the sheet against the left portion of a guide 34 as the sheet is pushed by entrance nip rollers 28 to reversing nip rollers 30. The entrance nip rollers 28 and the reversing nip rollers 30 continue to drive the sheet at their fast speed until the trailing edge of the sheet passes under an entrance sensor 66. From there, a predetermined constant time is measured by logic and control 50 (FIG. 1) until the reversing nip ramps down from its high speed and stops, positioning the trailing edge of the sheet at a location just past the end of plastic gate 64.

Once stopped, the sheet waits for a variable time period determined by its length. This dwell period is different for each paper size. The difference in dwell periods is used to equalize the total transport time within the subsystem for different sheet lengths to achieve proper duplex registration synchronization. When used in the FIG. 1 apparatus, it would equalize the total transport times for the various sheet lengths used with a particular in-track frame length. Actual termination of the dwell period depends on the application.

In the FIG. 1 apparatus, this termination is in response to an exit signal dependent on anticipated image arrival or formation at transfer station 9.

When this signal is received, the reversing nip ramps up to the same or a comparable speed to that in straight paper path 55 and pushes the sheet into an exit nip defined by exit nip rollers 32 as controlled by gate 64. After a third predetermined constant time, when the sheet trailing edge is out of the reversing nip defined by reversing nip rollers 30, the velocity of the reversing nip rollers is again changed from the slow outward speed to the fast inward speed in expectation of arrival of the next sheet.

Note that the stopping time of reversing nip rollers 30 is governed by the sensing of the trailing edge by entrance sensor 66 and that the start of reversing nip rollers 30 to feed the sheet out of the inverter is independent of its arrival and is instead synchronized to operation of stations downstream of the inverter. This means that any errors induced in the timing of the sheet upstream or in the reversing process are absorbed in the inverter itself and the sheet is back on schedule as it leaves the inverter. The acceleration to the sheet provided from entrance nip rollers 28 and later reversing nip rollers 30 provide a fast entrance of the sheet and allow this dwell period to correct for such upstream timing errors. It also allows the inverter to be used in the environment shown in FIG. 2 in which a straight paper path may be used by some sheets and the inverted sheets need to keep time with them. Prior art systems which accelerate the sheet in the inverter but do not slow it down as it exits feed a sheet traveling at an increased speed back to the paper path which sheet either must be handled at that speed or slowed down. Maintaining a high speed for the rest of the duplex path requires that the path be longer increasing the machine size. Slowing the sheet down requires extra technology and detracts from robustness because the tendency of the sheet to buckle. Thus, the inverter allows the sheet to be fed at a fast speed for a portion of its path and advantageously handles the slow down without merely feeding the sheet to slower moving nip.

It should be noted that the speed in the FIG. 1 apparatus as the sheet exits the inverter is still above the process speed of image member 1 although less than one-half the speed of entrance nip rollers 28. In FIG. 1, sheets moving in the paper supply portion 44 of the path including those received from exit nip rollers 32 continue at, for example, 26 inches per second until they reach registration device 19 where the sheets are finally slowed to the process speed of image member. Some buckle is not only acceptable but is usable at high quality registration devices.

FIG. 3 illustrates an alternative timing approach for the reversing rollers 30 of the inverter of FIGS. 1 and 2, which approach has several advantages. As seen in FIG. 3, the reversing rollers 30 await a sheet while still running at –26 inches per minute, i.e., the exit speed and direction. The leading edge of a sheet triggers entrance sensor 66 at time A. After an optional delay, the rollers are reversed to their entrance direction and speed until the trailing edge of the sheet is sensed by entrance sensor 66 at C. After a short delay to allow the trailing edge to clear gate 64, the rollers are stopped at D. At E an exit signal arrives from logic and control 50, and rollers 30 are driven in their exit direction, exiting the sheet. This is not timed, since the rollers are driven in the exit direction until the next sheet arrives.

Using the FIG. 3 timing approach, the only important timing aspects are the time between C and D and the exit signal at E. The delay between A and B is not necessary, but it can be used to cause the leading edge of the sheet to enter the nip of rollers 30 just before they are fully accelerated to the entrance speed. This can cause the sheet to buckle slightly, which has a tendency to correct skew.

An alternative design would eliminate any dwell in reversing nip rollers 30. Instead, the sheet would be driven into the inverter past gate 64. The sheet is immediately reversed and driven into the exit nip, with the exit nip rollers driving the sheet until its trailing edge has left the reversing nip rollers 30 as sensed by an appropriate exit sensor, not shown. The sheet is then stopped and held by the exit nip rollers 32 until the receipt of an appropriate signal. This has the disadvantage of more complexity in its timing but the advantage of less interaction between incoming and outgoing sheets.

FIG. 4 illustrates a problem associated with arrival of a skewed sheet at entrance nip rollers 28 in the FIG. 2 type structure. The stopping position of the sheet relative to the end of gate 64 is important when the incoming sheets are skewed. The timing must be adjusted so that the sheets stop far enough from the gate edge to account for any skew present. If an incoming sheet is too badly skewed, part of the sheet may still be under the gate in the stopped position. In this case, reversing of the sheet causes a collision in the path. One way to deal with excessive input skew is to stop all sheets well away from the gate. This has an adverse effect on the subsystem timing requirements, forcing the entrance and reversing nip velocities to increase to maintain the same dwell in the inverter. A better way to deal with excessive input skew is to add a second entrance sensor in the same in-track location as the first and separate the two sensors as far as possible in the cross-track direction (considering the cross-track sizes handled). These sensors, sensors 166 and 266, are shown in FIG. 4. Two sensor signals from sensors 166 and 266 are connected in series (logical AND) so that the deceleration of the sheet does not begin until the farthest part of the sheet has cleared the sensor on its side. With this approach, some extra time must be added since the skewed sheet will stop deeper into the reversing path, but the subsystem speed increase resulting from this is minimal.

Some skew will exist in the sheets coming from upstream transport rollers. It is possible though, that this existing skew will be amplified as the sheets reach the inverter entrance nip which is running significantly faster than the upstream nips (in most modes in FIG. 1). If a sheet is already skewed, then it will not contact all the entrance nips simultaneously. Rather, the sheet will enter one of the outboard entrance nips first, and that nip will try to accelerate the sheet before it has entered the others. If the upstream nips do not have as firm a grip on the sheet as the entrance nips, this may cause the sheet to rotate further in the direction of the pre-existing skew. A way to prevent this skew escalation is to construct the entrance nip of a more compliant material, such as a coated foam. When a skewed sheet enters one of the faster moving soft nips, the nip will attempt to accelerate the sheet. But since the sheet will be held somewhat by the previous set of upstream nips, the soft roller will flex and slip rather than pull the sheet out of the upstream rollers. Only when all of the entrance nip rollers have engaged the roller will its pulling power be sufficient to overdrive the upstream rollers as it accelerates the sheet.

A more complicated solution to this problem is to use an independent variable speed motor to drive the entrance nip rollers and ramp it up to full speed only after the initial portion of the sheet is in the nip. This solution is less desirable, since an advantage of the system is that both the entrance and exit nip rollers have constant speed drives.

The number of advantages of this fast-in, slow-out four roller reversing nip inverter design over conventional fast-in, fast-out three or four roller inverters can be seen from the discussion above. First, it allows the exit path speed to be as slow as possible, resulting in the smallest over all machine size without trying to slow sheets down while they are moving. Second, in the preferred embodiment, the entrance and exit rollers are driven at a constant speed at all times providing the highest robustness for the subsystem. (However, the design has the advantage that it is possible to use an independent motor at the entrance nip rollers to provide a ramp function as described above to prevent any amplification of skew that might occur there.) Third, it also makes it possible to stop the outgoing sheet using an exit sensor to reduce variation in sheet synchronization times and the interaction of sheets in the inverter. Fourth, in the operation of the FIG. 1 apparatus, the fast-in, slow-out inverter is used to provide substantial dwell times in the inverter and handle errors in sheet arrival times at the inverter as well as differences in sheet in-track length. Fifth, the fast-in, slow-out inverter handles the speed-up of variable speed rollers 26 accommodating the intermediate in-track frame length without unduly elongating the duplex path because of the speed up or by attempting to slow the sheet down after the inverter using slower driven roller pairs. Thus, the fist-in, slow-out inverter, while not essential for operation of the three in-track frame length approach described with respect to FIG. 1, greatly facilitates its operation.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

a finite length image member, means for forming a series of toner images on the image member, which series of toner images have a frame length equal to a distance between a point in one image and a comparable point in the next image, means for holding a supply of receiving sheets, each sheet having first and second sides, a transfer station including means for transferring a toner image from the image member to a first side of a receiving sheet, means for feeding a receiving sheet from the means for holding to the transfer station with the first side of the receiving sheet oriented to receive a toner image, means for feeding one or more receiving sheets through a finite length duplex path back to the transfer station to receive another toner image, means for inverting a sheet in the duplex path to change the side of the sheet being presented to a toner image at the transfer station, logic and control means for controlling the formation of the toner images on the image member and movement of the receiving sheets, said logic and control means including means for controlling image formation to form images in first, second and third frames having first, second and third different frame lengths, respectively, wherein the first frame length is approximately ½ the third frame length and the second frame length is more than the first frame length and less than the third frame length, and the finite length of the image member is an integer multiple of each of the frame lengths, and means for controlling movement of the sheets through the duplex path at a predetermined speed profile which is substantially the same for sheets bearing images formed in the first and third frames but is different for receiving sheets bearing images formed in the second frames.

2. Image-forming apparatus according to claim 1 wherein the predetermined speed profile for sheets bearing images formed in the second frames is substantially faster for a portion of the duplex path than is the speed profile for that portion of the duplex path for images formed in the first and third frames.

3. Image-forming apparatus according to claim 2 wherein said portion of the duplex path is positioned immediately upstream of the means for inverting and the means for inverting receives sheets bearing images formed in the second frames at said higher speed but feeds sheets out of said inverting means at a speed lower than said higher speed.

4. Image-forming apparatus according to claim 3 wherein said means for inverting includes means for accelerating sheets bearing images formed in the first and third frames to said higher speed as the sheets enter the inverting means but feeding sheets out of the inverting means at a lower speed than said higher speed.

5. Image-forming apparatus according to claim 1 wherein the first frame length is less than 10.5 inches, the third frame length is more than 12 inches and the second frame length is between 10.5 and 12 inches.

6. Image-forming apparatus according to claim 1 wherein said finite length image member is a seamed photoconductive endless belt.

7. Image-forming apparatus according to claim 6 wherein said seamed photoconductive endless belt has a circumference and the means for controlling image formation provides frame lengths such that six first frame lengths, five second frame lengths and three third frame lengths can be fit on one circumference of the image member.

8. Image-forming apparatus according to claim 1 wherein the speed profiles of sheets bearing images formed in the first, second and third frames and the length of the duplex path are such that sheets carrying images formed in the first, second and third frames return to the transfer station in time with every nine, seven and five flames of the image member, respectively.

9. Image forming apparatus according to claim 1 wherein the logic and control means further includes means for alternating images on the image member between images for the first side of a receiving sheet and images for the second side of a receiving sheet.

10. Image forming apparatus comprising:

means for holding a supply of receiving sheets, each sheet having first and second sides, an image transfer station including means for transferring or otherwise forming an image on a side of one of the receiving sheets, means for feeding a receiving sheet from the means for holding to the transfer station with the first side of the receiving sheet oriented to receive an image, means for feeding one or more receiving sheets through a finite length duplex path back to the transfer station to receive another image, means for inverting a sheet in the duplex path to change the side of the sheet oriented to receive an image at the transfer station, said inverting means including an inverter sheet guide, an entrance sheet drive for feeding a sheet into the inverter sheet guide at a first speed, and an exit sheet drive for feeding a sheet out of the inverter sheet guide at a second speed less than the first speed.

11. Image forming apparatus according to claim 10 wherein the second speed is less than half the first speed.

12. Image forming apparatus according to claim 10 further including a reversible sheet drive for receiving a sheet driven into the inverter guide and drivable in a first direction for driving the sheet further into the sheet guide until the sheet is free of the entrance sheet drive, said reversible sheet drive being drivable in a second direction reverse of the first direction to drive the sheet into the exit sheet drive.

13. Image forming apparatus according to claim 12 further including a logic and control including means for generating an exit signal timed with image transfer or formation at the transfer station and means for beginning drive of the reversible sheet drive in the second direction in response to said exit signal.

14. Image forming apparatus according to claim 13 further including a sheet edge sensing means associated with the entrance sheet drive and positioned to sense an edge of a sheet passing a predetermined position with respect to the entrance sheet drive and wherein said logic and control controls the operation of the reversible sheet drive through a cycle of operation including maintaining the reversible sheet drive in its second direction while awaiting the arrival of a sheet, reversing the direction of the reversible sheet drive in response to the sensing of a leading edge of a sheet by the sheet edge sensing means, stopping the reversible sheet drive in response to sensing of the trailing edge of a sheet by the sheet edge sensing means and driving the reversible sheet drive in its second direction in response to the exit signal received from the logic and control.

15. A sheet inverter comprising:

an inverter sheet guide, an entrance sheet drive for feeding a sheet into the inverter sheet guide at a first speed, and an exit sheet drive for feeding a sheet out of the inverter sheet guide at a second speed less than half the first speed.

16. A sheet inverter according to claim 15 further including a reversible sheet drive for receiving a sheet driven into the inverter sheet guide and drivable in a first direction for driving the sheet until its trailing edge is free of the entrance sheet drive, said reversible sheet drive being drivable in a second direction reverse of the first direction to drive the sheet into the exit sheet drive.

17. A sheet inverter according to claim 16 further including an edge sensor means associated with the entrance sheet drive and positioned to sense a trailing edge of a sheet having passed through a predetermined position with respect to the entrance sheet drive, and logic and control responsive to the edge sensor means for stopping the driving of the reversible drive a predetermined time after the sensing of such passing of the trailing edge of a sheet.

18. A sheet inverter according to claim 17 wherein said edge sensor means includes first and second sensors spaced from each other in a cross-track direction and means associated with the logic and control to stop the driving of the reversible drive a predetermined time after sensing the trailing edge by both sensors.

19. A sheet inverter according to claim 15 wherein said entrance sheet drive includes a set of entrance rollers which receive a sheet from a set of upstream rollers, which upstream rollers are driven at a speed less than the speed of the entrance rollers and wherein the entrance rollers are sufficiently softer than the upstream rollers that any skew in the sheet as it enters the entrance rollers is maintained by the upstream rollers and not magnified by the entrance rollers.

* * * * *

UNITED STATES PATENT AND TRADEMARK OFFICE

CERTIFICATE OF CORRECTION

PATENT NO. : 5,629,762
DATED : May 13, 1997
INVENTOR(S) : Gregory P. Mahoney et al

It is certified that an error appears in the above-identified patent and that said Letters Patent is hereby corrected as shown below:

Col 10, line 58, "flames" should read --frames--

Signed and Sealed this

Twenty-eighth Day of October, 1997

*Attest:*

Bruce Lehman

BRUCE LEHMAN

*Attesting Officer*

*Commissioner of Patents and Trademarks*